US010435956B2

(12) United States Patent
Shampine et al.

(10) Patent No.: US 10,435,956 B2
(45) Date of Patent: Oct. 8, 2019

(54) ROTARY SHOULDERED TOOL JOINT WITH NON-ROTATING CONNECTION MEANS

(71) Applicant: Schlumberger Technology Corporation, Sugar Land, TX (US)

(72) Inventors: Rod William Shampine, Houston, TX (US); Mark Callister Oettli, Richmond, TX (US); Simon Mattias Flander, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 188 days.

(21) Appl. No.: 15/295,610

(22) Filed: Oct. 17, 2016

(65) Prior Publication Data

US 2018/0106114 A1 Apr. 19, 2018

(51) Int. Cl.

| | |
|---|---|
| ***E21B 19/16*** | (2006.01) |
| ***E21B 17/042*** | (2006.01) |
| ***E21B 19/22*** | (2006.01) |

(52) U.S. Cl.

CPC ..... *E21B 17/042* (2013.01); *E21B 19/16* (2013.01); *E21B 19/22* (2013.01)

(58) Field of Classification Search

CPC ..... E21B 19/16; E21B 17/042

See application file for complete search history.

(56) References Cited

U.S. PATENT DOCUMENTS 5,269,385 A * 12/1993 Sihlis ..... E21B 7/067 175/322

OTHER PUBLICATIONS

National Oilwell Varco PCE CARSAC HT Connector; retrieved from website: www.nov.com/Segments/Wellbore_Technologies/Downhole/Intervention_and_Completion_Tools/Coiled_Tubing_Tools/CT_Joints_and_Weight_Straight_Bars/PCE_CARSAC_HT_Connector.aspx; Oct. 12, 2016; 2 pages.

LiMAR® Torque-Thru Deployment Connector product data sheet; retrieved from website: www.limaroiltools.com/coiled-tubing/torque-thru-deployment-connector; Oct. 12, 2016; 2 pages.

Hunting Torque Thru Quick Connector product data sheet; product code WT-3100; retrieved from website: www.hunting-intl.com/well-intervention-equipment/thru-tubing-technology/joints-and-stems/torque-thru-quick-connector; Oct. 12, 2016; 1 page.

Taylor Made® Oil Tools, Inc. Deployment Union product data sheet; retrieved from website: www.taylormadeoiltools.com/catalog.htm; Oct. 12, 2016; 2 pages.

* cited by examiner

*Primary Examiner* — Catherine Loikith

(57) ABSTRACT

A connector system includes a first sub and a second sub having a landing shoulder, and the first sub carries a threaded sleeve for engaging the second sub. The first sub includes a stinger section and a flying nut that provides a sealed and torque carrying connection when secured against the landing shoulder of the second sub. The first sub may be connected to the second sub without rotation of the ends of the first sub and the second sub. In some cases the first sub and the second sub are in any angular orientation when the sealed and torque carrying connection is provided. Further, the connector system may provide a connection between two sections of a downhole tool assembly without rotating or orienting in any way the angular position of the two sections. In some cases, torque applied in a wellbore milling operation further seals the sealed joint.

17 Claims, 4 Drawing Sheets

ROTARY SHOULDERED TOOL JOINT WITH NON-ROTATING CONNECTION MEANS

FIELD

The field to which the disclosure generally relates is to wellsite equipment such as oilfield surface equipment, downhole assemblies, coiled tubing (CT) assemblies, and the like.

BACKGROUND

This section provides background information to facilitate a better understanding of the various aspects of the disclosure. It should be understood that the statements in this section of this document are to be read in this light, and not as admissions of prior art.

Coiled tubing is a technology that has been expanding its range of application since its introduction to the oil industry in the 1960's. Its ability to pass through completion tubulars and the wide array of tools and technologies that can be used in conjunction with it make it a very versatile technology.

In the oilfield, downhole tools are commonly used to perform measurements and services in wells. These tools are necessarily shaped like the inside of a well, typically long and narrow. The length of these tools is dependent on what function they are to perform, and additional functions typically impart additional length. As more and more sophisticated functions are performed down hole, these tools have grown in length to the point where installing them in the well bore has become a significant challenge in the face of maintaining well control while this is performed. This process of placing tools into the well bore is referred to as deployment.

In coiled tubing, wireline, and slickline services downhole tools need to be transferred from the back of a truck to inside the well bore. This is commonly done by using a long riser with the conveyance means attached to the top. In this method, the tools are either pulled into the bottom of this riser, or are assembled inside the riser. The riser is then attached to a well, pressure tested, and then the tools are run into the well.

An alternative method is to have an easier to run service place the tools in the well, then have the harder service do the running in hole. In this method, the tools are provided with an additional part, such as a deployment bar. A deployment bar is intended to provide a surface that wellhead resident blow out preventers (BOPs) can both grip and seal on. In the case where the harder service is coiled tubing, wireline or slickline may be used to pre-place the tools in the coiled tubing BOP. The deployment bar used will then match the coiled tubing diameter. Once tools are hanging in the BOP, additional tools may be connected to them to increase the overall length of the tool string. In order to do this, a connection must be made between the sections. When an upper tool is carried by coiled tubing, it is not possible to rotate the tool to screw it into the hanging tool. However, this joint often needs to carry torque, meaning that a simple hold down nut is not adequate.

Hence, it remains desirable to provide improvements in oilfield surface equipment and/or downhole assemblies such as, but not limited to, methods and/or systems for deploying coiled tubing into wellbores using connections with tools which overcome the difficulties in the current art.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In a first aspect of the disclosure, a connector system is provided which includes a first sub and a second sub having a landing shoulder, and the first sub carries a threaded sleeve for engaging the second sub. The first sub includes a stinger section and a flying nut, which provide a sealed and torque carrying connection when secured against the landing shoulder of the second sub. The first sub may be connected to the second sub without rotation of the ends of the first sub and the second sub. In some cases the first sub and the second sub are in any angular orientation when the sealed and torque carrying connection is provided. Further, the connector system may provide a connection between two sections of a downhole tool assembly without rotating or orienting in any way the angular position of the two sections. In some cases, torque applied in a wellbore milling operation further seals the sealed joint. In some aspects, the first sub and the second sub are connected by axial motion of one of the first sub and second sub. The second sub may be stabbed into the first sub and an axial load applied before the sealed joint is made. Also, the sleeve may be sealed over the first sub and the second to prevent outside debris from entering the connection.

In some aspects, the flying nut is driven toward the shoulder to hold an axial load by a housing that uses a difference in lead in threaded surfaces to drag or push the flying nut to the shoulder thus ensuring sufficient axial load holding and torque holding capability for the connection. Threads on the threaded sleeve may be of greater pitch than threads on the flying nut. The threads of the sleeve can have a threads per inch (TPI) of N, where N is in the range of from 2 to 20, or 4 to 20, or 6 to 10; and the threads for at least a portion of the flying nut can have a TPI of N+X, where X is in the range of from 0.5 to 10, or 2 to 10, or 2 to 4; such as, but not limited to, threaded sleeve threads of 8 TPI and flying nut threads of 10 TPI. The threads on the threaded sleeve and threads on the flying nut may, in some cases, differ in that the two threads differ in number of thread starts, such as two 8 TPI threads where one is single start and one is double start; for example, where one set of threads is single start and one set of threads is double start. The difference in the number of starts can also be 2, where one set of threads is single start and one set of threads is triple start. Also, the threaded sleeve may have threads which tighten the sealed and torque carrying connection when the tool is rotating and subject to the friction drag on a wellbore wall.

In some cases, the flying nut is aligned on the first sub with a torque holding mechanism while allowing axial travel, and the torque holding mechanism may be one of any polygonal shaped flats (including, but not limited to, hexagonal flats or octagonal flats), slots, keyed mechanism or splines. The flying nut may be a single nut assembled over a torque holding mechanism on the first sub and a temporary separation of a down hole shoulder is used to install the flying nut. The flats for axial travel of the flying nut are disposed on the outside surface of the flying nut and a mating surface inside the sleeve and a threads are disposed on a mandrel of the first sub. In some cases, a spring is disposed adjacent the flying nut to provide additional axial push force on the flying nut when traveling toward the shoulder on the second sub. The spring in contact with the flying nut may function such that tightening the connection compresses the spring, thereby adding additional tensile energy storage to the connection and increasing vibration loosening resistance.

A hydraulic pump may be used to lubricate the first sub and the second sub during assembly, where fluid is injected and ejected in such a way that it pushes or aids in the pushing and rotation of the flying nut. Also, an internally tapered guide may be disposed on the stinger of the first sub to guide the second sub into the bore of the first sub. In some cases, the first sub is disposed on a lower tool and the second sub is disposed on an upper tool or distal end of a coiled tubing.

In another aspect of the disclosure, a downhole sub is provided for connecting to a second sub, where the downhole sub includes a threaded sleeve for engaging the second sub, a stinger section and a flying nut which creates a sealed joint when secured against a landing shoulder disposed on the second sub. The first and second subs may include any of the features described hereinabove.

Yet other aspects are methods for connecting coiled tubing equipment in a wellhead by providing downhole sub including a threaded sleeve for engaging a second sub, a stinger section and a flying nut, which creates a sealed joint. The second sub includes a landing shoulder and threads for engaging the sleeve. The sleeve is rotated until the flying nut is secured on the landing should to create a sealed joint. The first sub may be connected to the second sub without rotation of the ends of the first sub and the second sub, and the first sub and the second sub are in any angular orientation when the sealed joint is created.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
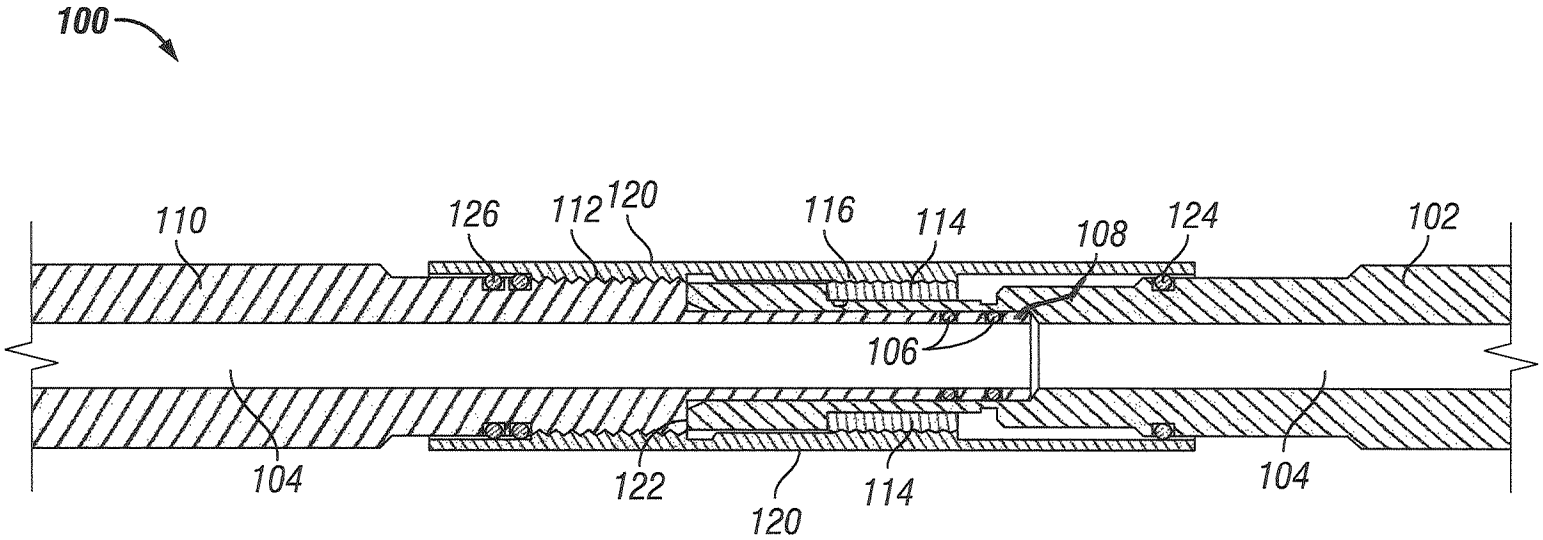
FIG. 1 illustrates a torque carrying quick connector system in a sealingly connected state, in accordance with an aspect of the disclosure, in a cross-sectional view.

The following description of the variations is merely illustrative in nature and is in no way intended to limit the scope of the disclosure, its application, or uses. The description and examples are presented herein solely for the purpose of illustrating the various embodiments of the disclosure and should not be construed as a limitation to the scope and applicability of the disclosure.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Embodiments of the disclosure relate to a systems and methodologies for forming coiled tubing connections. The coiled tubing connections typically are formed between coiled tubing and a well tool for use downhole, however the coiled tubing connections can be formed between coiled tubing and other components, such as subsequent sections of coiled tubing. The coiled tubing connections are formed with a connector that is of similar outside diameter to the coiled tubing and uniquely designed to provide a secure, rigorous connection without limiting the ability of the connector to pass through wellhead equipment.

Some embodiments of the disclosure are directed to torque carrying quick connectors, which do not require either the top, or bottom parts of the connector to be rotated. Torque carrying is achieved by the connector acting as a rotary shouldered connection. In some aspects the quick connection utilizes a nut having two different lead threads on which engage a male thread on one half of the connector, and engages a sliding nut on the other half. The difference in thread leads allows the joint to be tightened. Such torque carrying quick connectors may be useful in connecting downhole tools together, or connecting a downhole tool or tool string with a coiled tubing conveyance.

In some embodiments, torque carrying quick connectors include five or more elements, and many variations on the elements described are possible, as well as additional components, and all are within the scope of the disclosure. A first sub carries bore sealing O-rings disposed on a stinger portion of the first sub. As used herein the term 'sub' means a small component, section or portion of the coiled tubing tool string. A second sub has a threaded section disposed on an outer peripheral section just above a shoulder defined on the second sub. A flying nut having an external peripheral threads and an internal anti-rotation feature is slidingly disposed adjacent the outer surface of the stinger of the first sub. An outer sleeve is disposed around an outer peripheral section of the first sub, and the outer sleeve has inner threads which engageably match external threads on the flying nut.

In general, the stinger from the first sub is introduced onto the distal end of the second sub, and the outer sleeve is rotated to engage threads on the second sub. As the sleeve is rotated, the second sub is drawn deeper into the stinger and the flying nut moved nearer the shoulder on the second sub. The flying nut, which does not rotate simultaneously with the rotating sleeve, continues to move toward the shoulder while the sleeve rotates, until the nut stops on the shoulder. O-rings seal from the second sub on a stinger portion of the first sub provide a sealed connection between the first sub and the second sub, together defining a common sealed fluid passageway there through. As described in further detail below, the system may include additional O-rings and other features.

One feature of some such connectors according to the disclosure is torque applied to a lower sub (by a mill, for example) may cause the connection joint to further tighten, or otherwise not come loose. Further, the joint may be made up or separated by rotating the top and bottom sub relative to each other, just like a regular rotary shouldered joint. Additionally, embodiments of the disclosure eliminate any need to rotate a tool or coiled tubing end to connect to a hanging tool already present in the wellbore Now referring to FIG. 1, which depicts a torque carrying quick connector system 100, in a cross-sectional view, according to an embodiment of the disclosure. The view is rotated 90 degrees counterclockwise for ease of understanding. The right(or typically lower) sub 102 is sealed with fluid passageway 104 sealing O-rings 106 on a stinger portion 108 of the upper sub 110. The upper (left) sub 110 has a threaded section 112 adjacent sleeve 120 just above shoulder 122. The threads of section 112 adjacent sleeve 120, and the corresponding threads on sleeve 120, can each have a TPI of N, where N is in the range of from 2 to 20, or 4 to 20, or 6 to 10. Flying nut 114 is equipped with external threads 116 disposed around the periphery, and an internal anti-rotation feature that slides on sub 102. External threads 116 for at least a portion of the flying nut, and the corresponding threads on sleeve 120 adjacent external threads 116, can have a TPI of N+X, where X is in the range of from 0.5 to 10 or 2 to 10, or 2 to 4. In some aspects, the internal anti-rotation feature may be any suitable device, such as one of any polygonal shaped flats (including, but not limited to, hexagonal flats or octagonal flats), slots, keyed mechanisms, or splines.

In some embodiments, flying nut 114 may be split for ease of installation, or there may be a joint in the system to allow a non-split nut to be installed, and each of the splits can have a TPI of N+X, where X is in the range of from 0.5 to 10 or 2 to 10, or 2 to 4. In some other cases, the left thread may be a single start thread, and the right thread a double start thread. Outer sleeve 120 has internal threads to engageably match threads 116 of flying nut 114. The upper and lower ends of outer sleeve 120 may engage seals 124 and 126 in order to seal the connection from contamination downhole.

Figure 2:
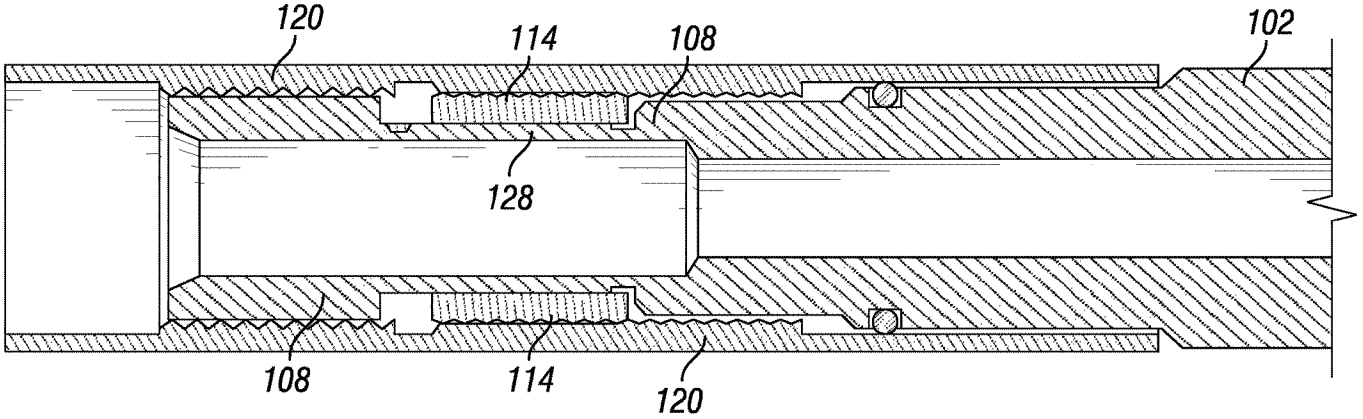
FIGS. 2 and 3 depict a torque carrying quick connector system in a first and second state of connection, in accordance with the disclosure, in a cross-sectional view.
Figure 3:
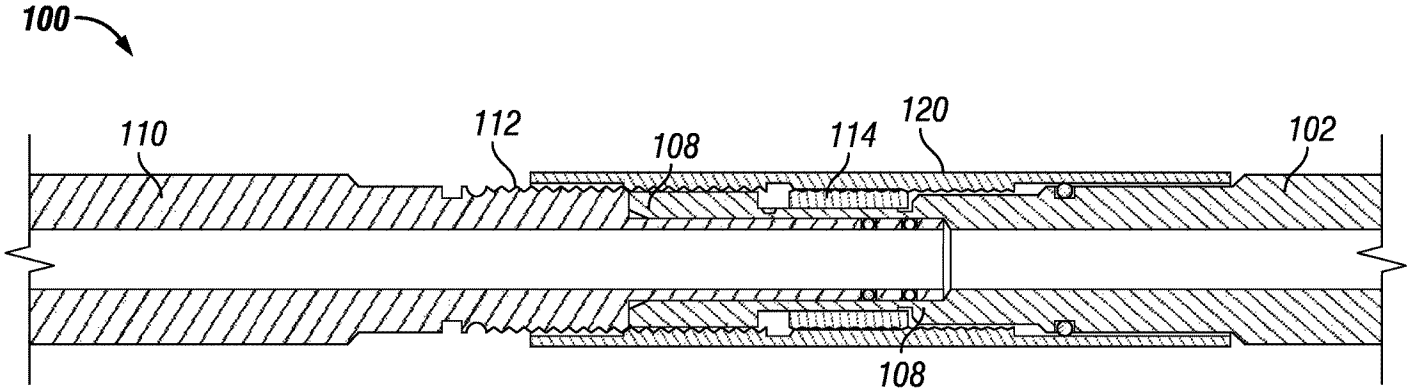

Now referring to FIGS. 2 and 3, which depict the torque carrying quick connector system 100 in a first and second state of connection. As depicted in FIG. 2, sub 102 is shown ready to introduce stinger 108 into sub 110 (not shown), or otherwise known as ready to stab. The flying nut 114 is at the bottom of its travel and is positioned at the bottom of section 128 of sub 102. Section 128 may be one of any polygonal shaped flats (including, but not limited to, hexagonal flats or octagonal flats), slots, keyed mechanisms, or splines, or any other suitable outer shape, which serves as an anti-rotation feature to prohibit flying nut 114 from rotating, as sleeve 120 rotates. Sleeve 120 is shown retracted on sub 102. As shown in FIG. 3, stinger 108 is introduced into sub 110 but sleeve 120 not yet engageably rotated onto threads 112 of sub 110. Flying nut 114 is shown in the bottom position as well.

Figure 4:
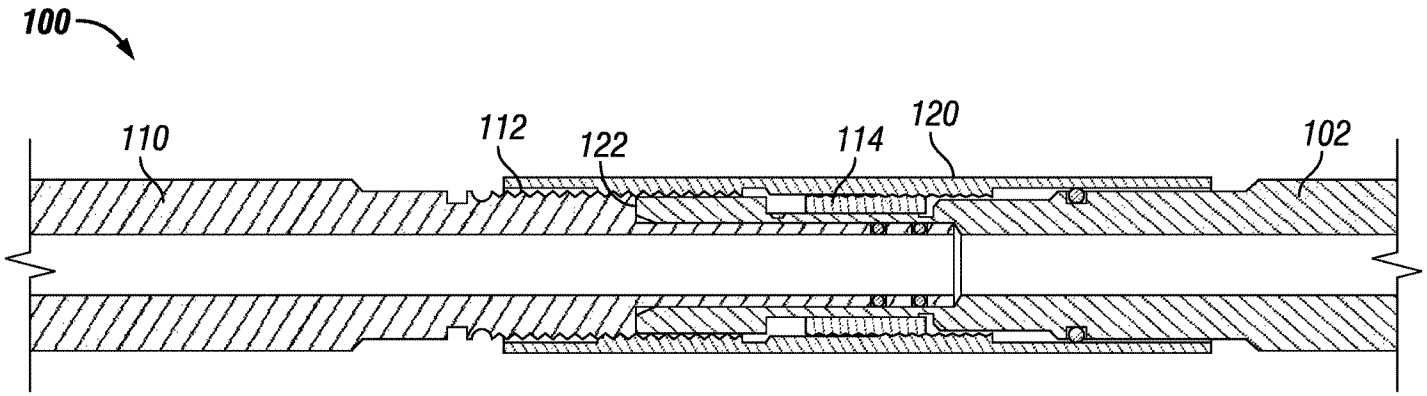
FIGS. 4 and 5 show a torque carrying quick connector system in a third and fourth state of connection, in accordance with some aspects of the disclosure, in a cross-sectional view.
Figure 5:
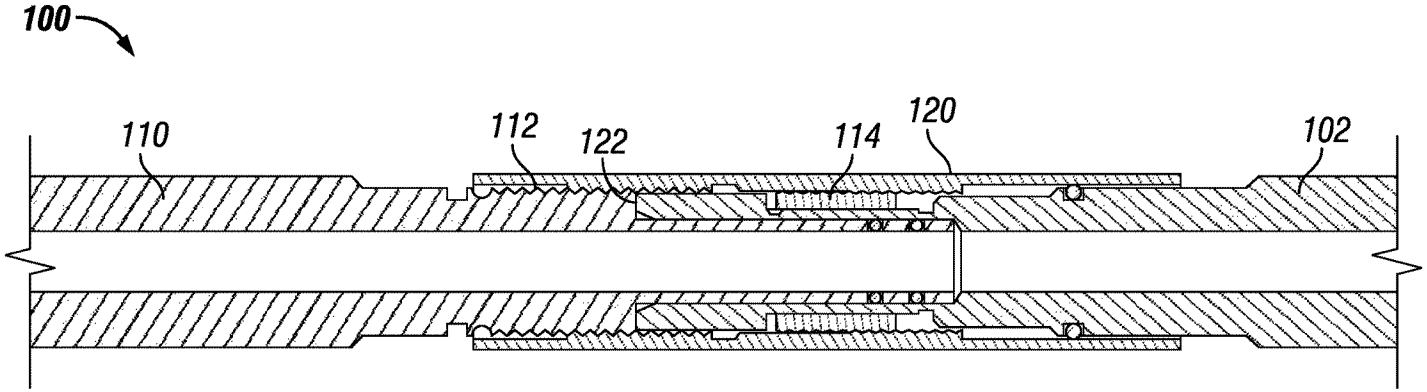

FIGS. 4 and 5 illustrate the torque carrying quick connector system 100 in a third and fourth state of connection. Generally, sleeve 120 may, in some cases, need to rotate almost a full turn before threads of sleeve 120 begin engage those threads at section 112 of sub 110, due to the random relative orientation of sub 110 and sub 102. Once engaged and in rotation, the threads of sleeve 120 engaged with sub 110 section 112 pull flying nut 114 with it toward shoulder 122, as shown in FIGS. 4 and 5. Flying nut 114 moves toward the shoulder 122 at a rate slower than the movement rate of sleeve 120 in a direction toward sub 110. The end result is the flying nut 114 travels up and clamps against shoulder 122, as depicted in FIG. 1. The effective thread pitch at closure (where flying nut 114 clamps against shoulder 122) is the difference between the pitch for the threads of section 112 of sub 110 and the pitch for the external threads 116 of the flying nut 114 (where thread pitch is defined as the reciprocal of TPI). This difference between pitches creates the effect of a fine thread (high clamping load with low torque) without the attendant failings of a fine thread (easy to damage, very little wear margin, sensitive to diameter changes in the parts, and small radial engagement). As a result, relatively little torque is required on the sleeve 120 to generate significant clamping load. When torque is applied to sleeve 120, a preload may be developed there, similar to a rotary shouldered connection.

Figure 6:
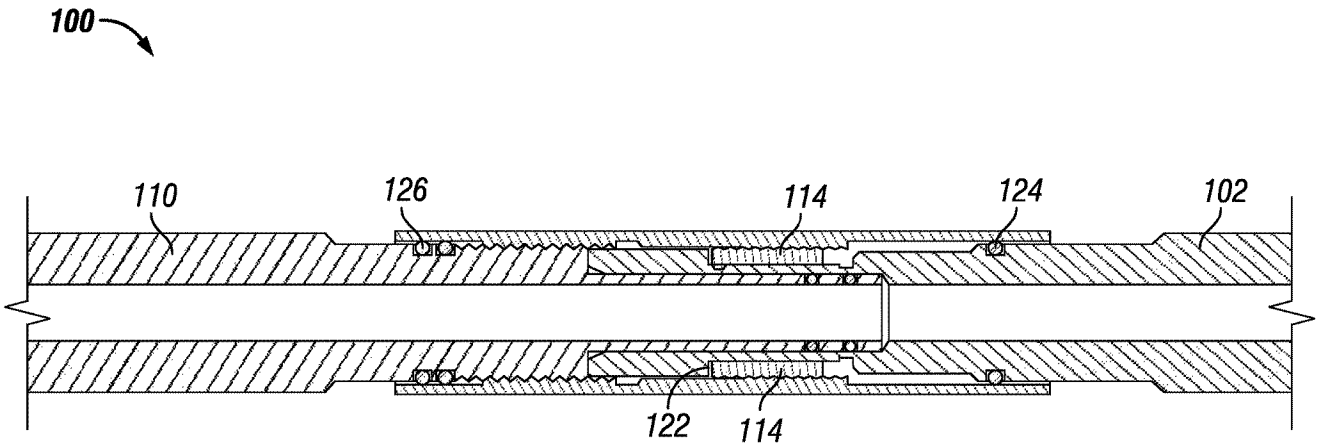
FIG. 6 illustrates a torque carrying quick connector system in a seals engaged state of connection, in accordance with some aspects of the disclosure, in a cross-sectional view; and, FIG. 7 depicts another torque carrying quick connector system in a cross-sectional view, according to another embodiment of the disclosure.

FIG. 6 shows sealing O-rings 126 and 124 engaged with sleeve 120, before flying nut 114 finally clamps against shoulder 122 of sub 110. The O-ring sealed sections may provide a debris-proof cavity for the threads, and in some cases, they may be removed to further shorten the tool(s). In some alternative embodiments, a 'vee' packing arrangement is used, instead of sealing O-rings 126 and 124, as a pressure compensating chamber allowing a small amount of external fluid to ingress while preventing that same fluid from exiting. In such cases, this arrangement may eliminate the atmospheric pressure chambers in the tool and rendering the connection insensitive to absolute pressure downhole while still preventing debris from entering the tool in any significant quantities. The chamber could also be grease-filled or oil-filled at surface to further reduce debris ingression.

Now referring again to FIG. 1, which shows the connection system fully engaged, and sealingly connecting sub 102 with sub 110. In some cases, the position of sleeve 120 may vary as much as the lead of the threads in section 112 of sub 110 (for example, such as ⅛" for a single start 8 TPI thread) due to relative orientation of subs 102 and 110.

Figure 7:
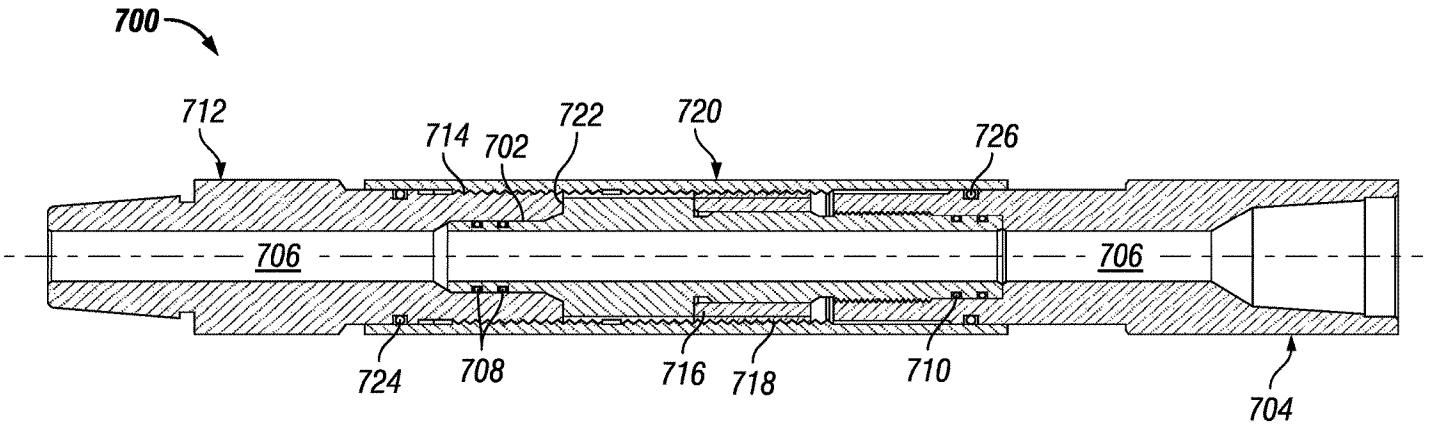

FIG. 7 depicts another torque carrying quick connector system 700, in a cross-sectional view, according to another embodiment of the disclosure. In this embodiment, the stinger 702 direction is inverted, as well as connected with and extending from sub 704, in comparison to connector system 100, described above; however, the overall connection mechanism is similar and the ranges and descriptions, such as the TPI ranges, related to system 100 are incorporated into this system 700. The right (or typically lower) sub 704 is sealed with fluid passageway 706 sealing O-rings 708 on a stinger portion 702 of the sub 704, and sealing O-rings 710. The upper (left) sub 712 has a threaded section 714 adjacent outer sleeve 720 just above shoulder 722. Flying nut 716 is equipped with external threads 718 disposed around the periphery, and an internal anti-rotation feature that slides along the stinger portion 702. Outer sleeve 720 has internal threads to engageably match threads 718 of flying nut 716. The upper and lower ends of outer sleeve 720 may engage seals 724 and 726 in order to seal the connection from contamination.

Another advantage of some connection system embodiments according to the disclosure is joining of subs may be made or separated by rotating the top and bottom sub relative to each other, just as with a regular rotary shouldered joint.

In some aspects of the disclosure, a small difference in thread lead is advantageous, in that the relatively small requisite sleeve torque is closer to that of a normal joint. For example, a one start/two start pair results in a shorter joint (because the flying nut does not require as long of a thread), but the resulting joint torque characteristics are equal to a 1.5 start thread due to the differential action. In some other aspects, opposite left/right threads may also be used to create this characteristic, and in some cases locking the left hand flying nut thread may be used to get the rotary shouldering behavior.

The connector systems described herein can be used to connect coiled tubing, and/or coiled tubing tools to a variety of components used in well applications. Additionally, the unique design of the connector enables maximization of flow area while maintaining the ability to pass the connector through wellhead components. The connector and the methodology of using the connector also enable preparation of coiled tubing connections while at a well site. Additionally, a variety of locking mechanisms can be combined with the connector, if necessary, to prevent inadvertent disconnection of the connector from an adjacent component. The systems and techniques discussed above can be used for all tool joints in a downhole tool string.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A connector system comprising:

a first sub comprising a stinger section;

a second sub comprising a landing shoulder;

a flying nut; and a threaded sleeve threadably engaging the flying nut and threads on the second sub, the system providing a sealed and torque carrying connection when secured against the landing shoulder of the second sub, and wherein the first sub may be connected to the second sub without rotation of the ends of the first sub and the second sub.

2. The connector system of claim 1, wherein the first sub and the second sub are in any angular orientation when the sealed and torque carrying connection is provided.

3. The connector system of claim 1, wherein the connector system provides a connection between two sections of a downhole tool assembly without rotating or orienting in any way the angular position of the two sections.

4. The connector system of claim 1, wherein torque applied in a wellbore milling operation further seals the sealed joint.

5. The connector system of claim 1, wherein the second sub is stabbed into the first sub and an axial load applied before the sealed joint is made.

6. The connector system of claim 1, wherein the flying nut is driven toward the shoulder to hold axial load by a housing that uses a difference in lead in threaded surfaces to drag or push the flying nut to the shoulder thus ensuring sufficient axial load holding and torque holding capability for the connection.

7. The connector system of claim 1, wherein threads on the threaded sleeve have a higher threads per inch (TPI) than a TPI for the threads on the flying nut.

8. The connector system of claim 1, wherein threads on the threaded sleeve and threads on the flying nut differ in that the two threads differ in number of thread starts.

9. The connector system of claim 1, wherein the sleeve is sealed over the first sub and the second sub to prevent outside debris from entering the connection.

10. The connector system of claim 1, wherein the flying nut is aligned on the first sub with a torque holding mechanism while allowing axial travel, and wherein the torque holding mechanism is one of polygonal shaped flats, slots, keyed mechanisms, or splines.

11. The connector system of claim 1, wherein the flying nut is a single nut assembled over a torque holding mechanism on the first sub and a temporary separation of a down hole shoulder is used to install the flying nut.

12. The connector system of claim 1, wherein flats for axial travel of the flying nut are disposed on the outside surface of the flying nut and a mating surface inside the sleeve and threads are disposed on a mandrel of the first sub.

13. The connector system of claim 1, wherein an internally tapered guide is disposed on the stinger of the first sub to guide the second sub into a bore of the first sub.

14. The connector system of claim 1, wherein the first sub is disposed on a lower tool and the second sub is disposed on an upper tool or distal end of a coiled tubing.

15. The connector system of claim 1, wherein the threaded sleeve comprises threads which tighten the sealed and torque carrying connection when the tool is rotating and subject to the friction drag on a wellbore wall.

16. A downhole sub for connecting to a second sub, the downhole sub comprising:

a stinger section;

a flying nut; and a threaded sleeve for threadably engaging the second sub and the flying nut, which creates a sealed joint when secured against a landing shoulder disposed on the second sub.

17. A method for connecting coiled tubing equipment in a wellhead, the method comprising:

providing a first sub comprising a stinger section, a flying nut, and a threaded sleeve for threadably engaging a second sub and the flying nut, which creates a sealed joint;

providing the second sub, wherein the second sub comprises a landing shoulder and a seal for engaging the sleeve; and rotating the sleeve until the flying nut is secured on the landing shoulder to create a sealed joint;

wherein the first sub and the second sub each comprise first and second ends and wherein the first sub is connected to the second sub without rotation of the ends of the first sub and the second sub, and wherein the first sub and the second sub are in any angular orientation when the sealed joint is created.

* * * * *